US005285585A

United States Patent [19]

Baker

[11] Patent Number: 5,285,585

[45] Date of Patent: Feb. 15, 1994

[54] SOUND EMITTING INFANT BOOT STRUCTURE

[76] Inventor: Sharene M. Baker, 905 E. 26th St., Farmington, N. Mex. 87401

[21] Appl. No.: 9,150

[22] Filed: Jan. 26, 1993

[51] Int. Cl.[5] ..... A43B 3/30

[52] U.S. Cl. ..... 36/112; 446/207; 446/267; 446/227; 36/139

[58] Field of Search ..... 36/139, 3 R, 112, 1, 36/90, 3 A; 446/207 X, 204, 74, 267 X, 227 X; 606/236, 234; 215/11.1

[56] References Cited

U.S. PATENT DOCUMENTS

| | | | |
|---|---|---|---|
| D. 185,235 | 5/1959 | Raffaelli | 446/204 X |
| D. 189,082 | 10/1960 | Goodman | 36/112 X |
| 1,271,891 | 7/1918 | Gustin | 280/843 |
| 1,661,283 | 3/1928 | Eckardt | 446/227 |
| 2,014,236 | 9/1935 | McNamara | 215/11.1 X |
| 2,095,942 | 10/1937 | Wetterstrand | 36/1 X |
| 2,330,538 | 9/1943 | Allen | 446/227 |
| 2,612,135 | 9/1952 | Iny | 36/112 X |
| 2,729,024 | 1/1956 | Guthmann | 446/267 X |
| 2,741,038 | 4/1956 | Eliassen | 36/3 R |
| 2,763,960 | 9/1956 | Wintriss | 446/207 X |
| 3,340,846 | 9/1967 | Magiera | 36/139 X |
| 3,468,445 | 9/1969 | Ballin | 215/11.1 X |
| 3,473,198 | 10/1969 | Meier | 36/1 X |
| 3,627,161 | 12/1971 | Wergeland | 446/81 X |
| 3,850,429 | 11/1974 | Clifford | 36/139 X |
| 4,277,910 | 7/1981 | Kramer | 446/73 |
| 4,538,368 | 9/1985 | Mugford | 36/7.1 RX |
| 4,771,556 | 9/1988 | Kim | 36/139 |
| 4,965,888 | 10/1990 | Jones | 2/104 |
| 5,072,843 | 12/1991 | James | 215/11.1 X |

FOREIGN PATENT DOCUMENTS

| | | | |
|---|---|---|---|
| 6121 | 2/1927 | Australia | 36/112 |
| 1036087 | 9/1953 | France | 36/112 |
| 0012368 | 4/1900 | United Kingdom | 36/3 R |

*Primary Examiner*—Paul T. Sewell
*Assistant Examiner*—Ted Kavanaugh
*Attorney, Agent, or Firm*—Leon Gilden

[57] ABSTRACT

A boot structure, wherein each boot includes an inner and outer wall, having an enclosed pneumatic chamber, wherein the outer wall includes a whistle member arranged in communication through the outer wall with the chamber to effect whistling upon compressing of air within the chamber during walking to enhance and induce infants for amusement during such walking.

1 Claim, 4 Drawing Sheets

SOUND EMITTING INFANT BOOT STRUCTURE

BACKGROUND OF THE INVENTION

1. Field of the Invention

The field of invention relates to infant shoe covering, and more particularly pertains to a new and improved sound emitting infant boot structure wherein the same is arranged to effect audible emissions during walking.

2. Description of the Prior Art

Boots of various types, as well as shoe coverings, are available in the prior art as exemplified in the U.S. Pat. Nos. 3,895,452; 5,031,904; and 4,976,050 as examples.

The instant invention in overcoming deficiencies of the prior art provides for a shoe covering to enhance amusement and enjoyment of an infant during walking to induce an infant for such walking, and is directed in the prior art and such is attained by the instant invention.

SUMMARY OF THE INVENTION

In view of the foregoing disadvantages inherent in the known types of shoe covering structure now present in the prior art, the present invention provides a sound emitting infant boot structure wherein the same is arranged to effect a whistling during compression of a pneumatic chamber within a shoe structure. As such, the general purpose of the present invention, which will be described subsequently in greater detail, is to provide a new and improved sound emitting infant boot structure which has all the advantages of the prior art shoe covering structure and none of the disadvantages.

To attain this, the present invention provides a boot structure wherein each boot includes an inner and outer wall having an enclosed pneumatic chamber, wherein the outer wall includes a whistle member arranged in communication through the outer wall with the chamber to effect whistling upon compressing of air within the chamber during walking to enhance and induce infants for amusement during such walking.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sound emitting infant boot structure which has all the advantages of the prior art shoe covering structure and none of the disadvantages.

It is another object of the present invention to provide a new and improved sound emitting infant boot structure which may be easily and efficiently manufactured and marketed.

It is a further object of the present invention to provide a new and improved sound emitting infant boot structure which is of a durable and reliable construction.

An even further object of the present invention is to provide a new and improved sound emitting infant boot structure which is susceptible of a low cost of manufacture with regard to both materials and labor, and which accordingly is then susceptible of low prices of sale to the consuming public, thereby making such sound emitting infant boot structure economically available to the buying public.

Still yet another object of the present invention is to provide a new and improved sound emitting infant boot structure which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
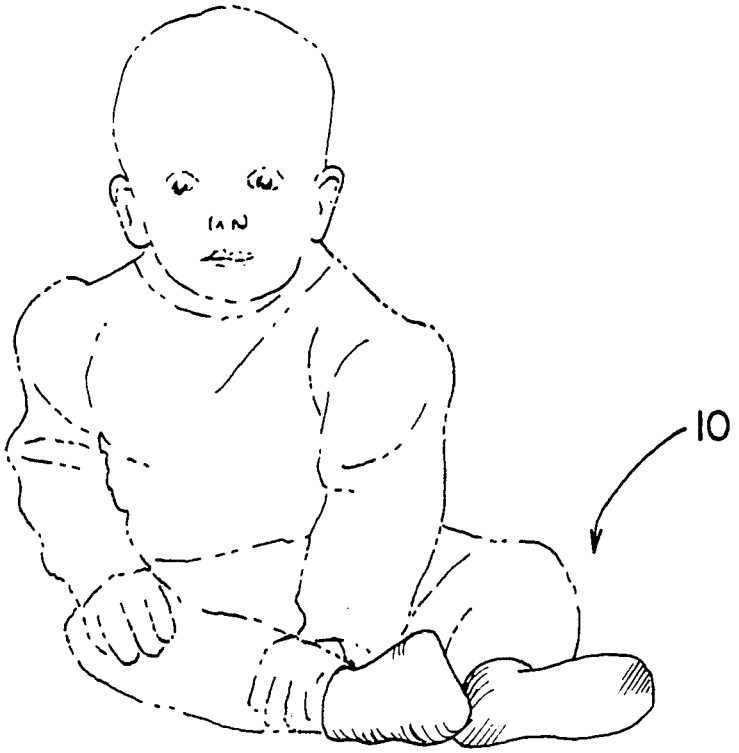
FIG. 1 is an isometric illustration of the invention as worn by an infant.
Figure 2:
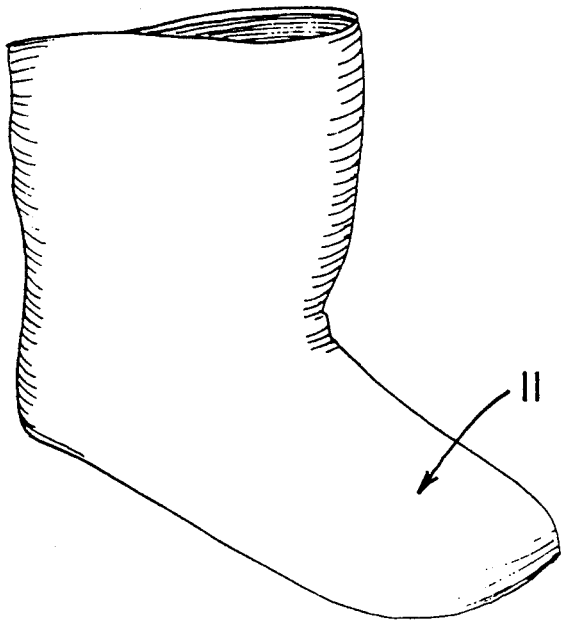
FIG. 2 is an isometric illustration of an individual boot member of the invention.
Figure 3:
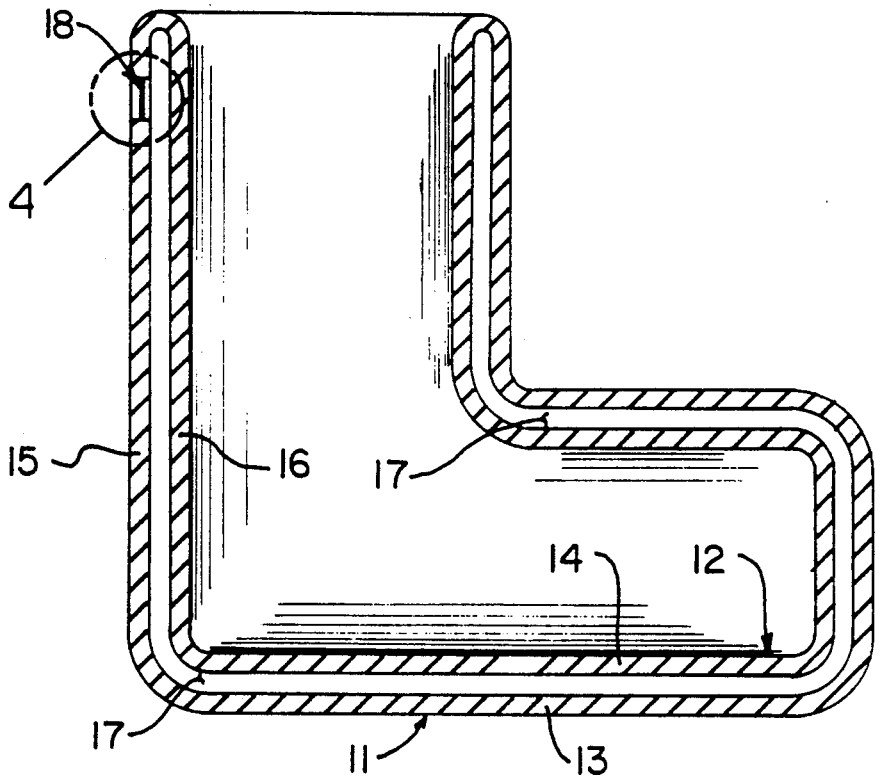
FIG. 3 is an orthographic cross-sectional illustration of the boot structure as set forth in FIG. 2.

With reference now to the drawings, and in particular to FIGS. 1 to 9 thereof, a new and improved sound emitting infant boot structure embodying the principles and concepts of the present invention and generally designated by the reference numeral 10 will be described.

More specifically, the sound emitting infant boot structure 10 of the instant invention essentially comprises an outer boot shell 11 positioned in an exterior relationship relative to an inner boot shell 12, wherein the outer boot shell and the inner boot shell are spaced relative to one another to define a contained pneumatic chamber 17. The outer boot shell 11 includes an outer boot foot wall portion 13 and an outer boot ankle wall portion 15, wherein the inner boot shell 12 includes an inner boot foot wall portion 14, and an inner boot ankle wall portion 16. A whistle member 18 is directed through the outer boot ankle wall portion 15 in communication with the pneumatic chamber 17. In this manner, compression of the pneumatic chamber 17 during a walking procedure effects whistling through the whistle member 18. The outer and inner boot shells 11 and 12 respectively are formed of a flexible pneumatically impermeable material.

Figure 4:
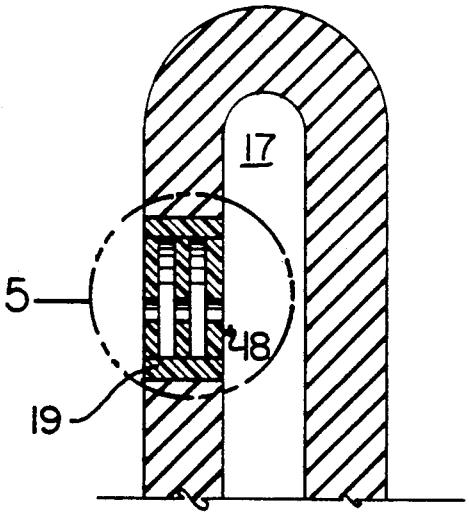
FIG. 4 is an enlarged orthographic view of the whistling structure as set forth in FIG. 3, as indicated by section 4 in FIG. 3.
Figure 5:
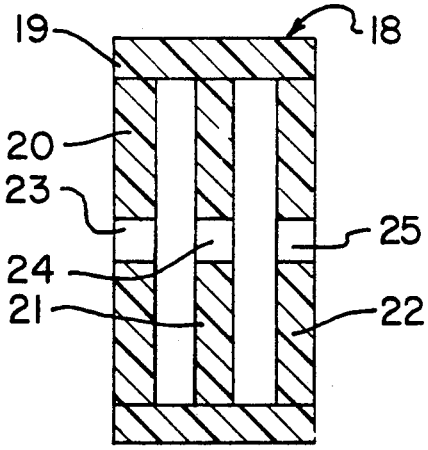
FIG. 5 is an enlarged orthographic view of the whistling structure.
Figure 5A:
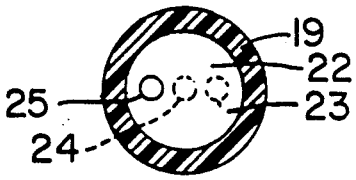
FIG. 5*a* is a modified aspect of the whistling structure of the invention.
Figure 6:
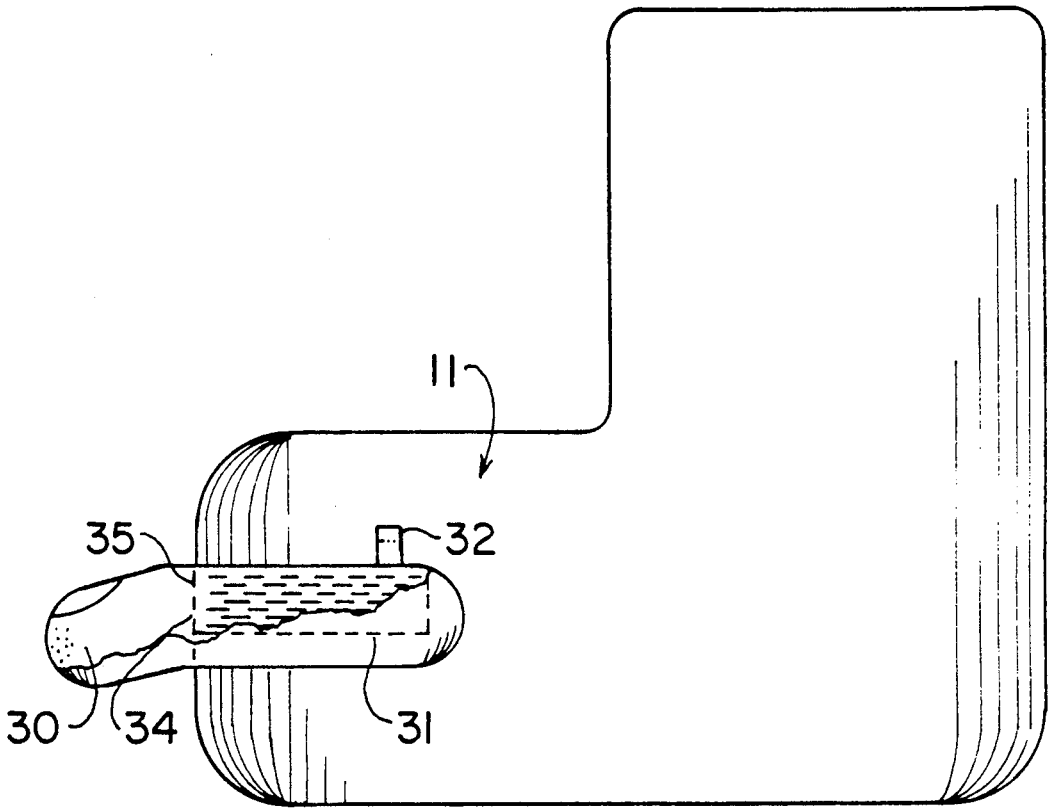
FIG. 6 is an orthographic side view, partially in section, of the boot structure including a fluid dispensing component within the boot structure.
Figure 7:
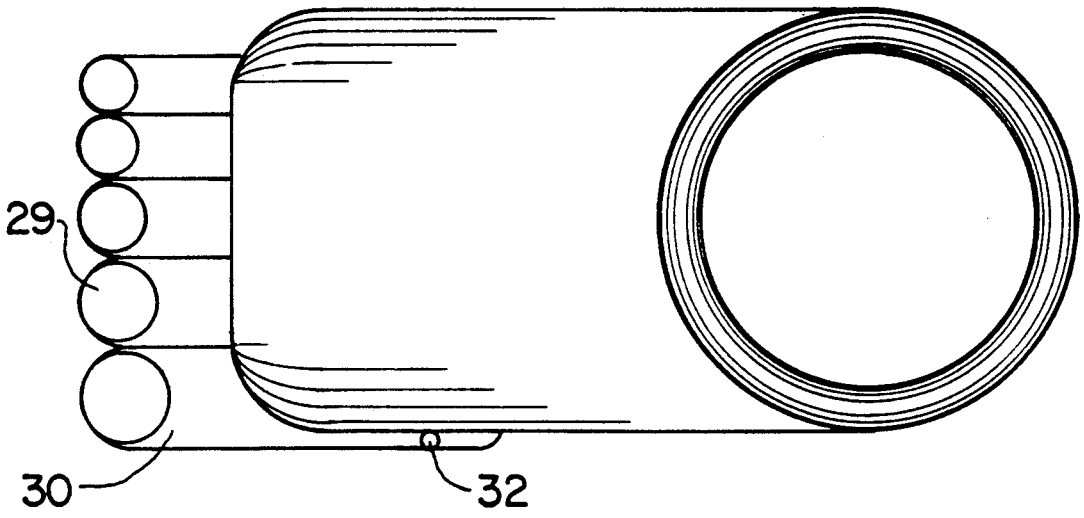
FIG. 7 is an orthographic top view of the invention, as indicated in FIG. 6.

The whistle member 18, as indicated in the FIGS. 4-5a, includes a rigid support tube 19 mounted within the outer boot ankle wall portion 15. Respective first, second, and third diaphragm plates 20, 21, and 22 are arranged in a parallel relationship within the support tube 19 and having respective first, second, and third whistle apertures 23, 24, and 25. The FIG. 5 indicates first, second, and third whistle apertures 23, 24, and 25 displaced and offset relative to one another to force air directed from the pneumatic chamber 17 exteriorly of the outer boot shell 11 to follow a circuitous path to thereby modify the whistling effected by each of the diaphragm plates of the first, second, and third diaphragm plates 20, 21, and 22.

Figure 8:
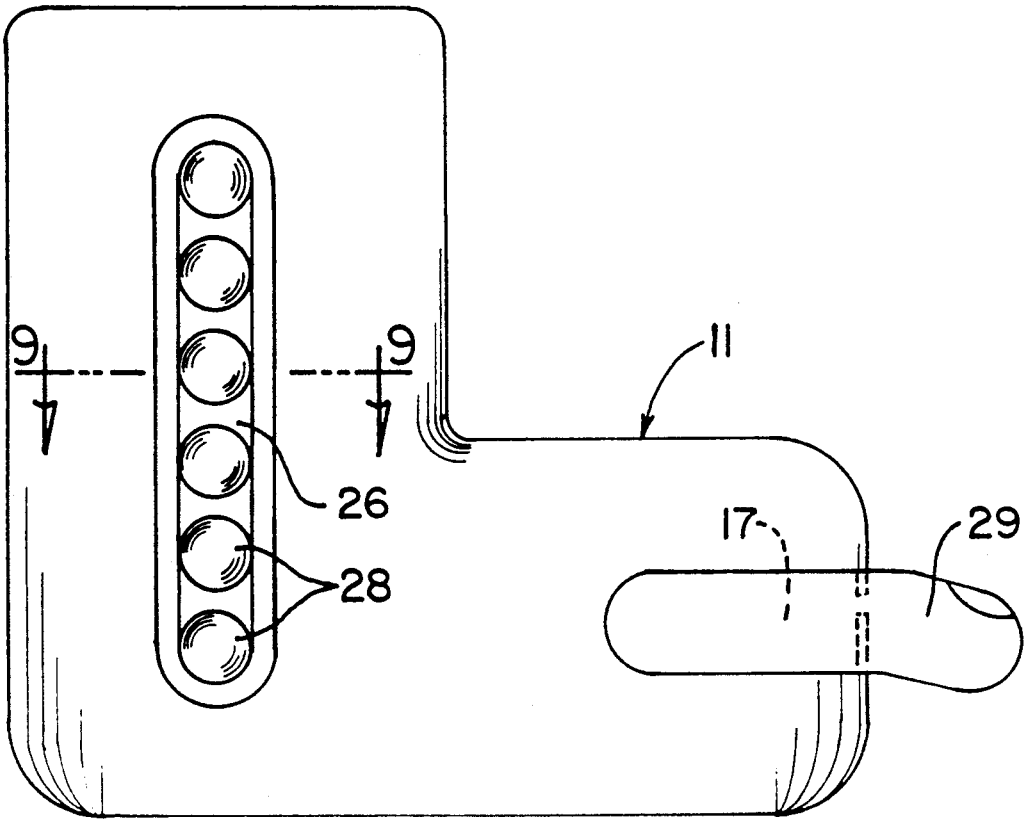
FIG. 8 is an orthographic side view of the invention to include rotary spherical members.

The FIG. 8 indicates the use of an outer shell recess 26 having a row of spherical members 27, each rotatably mounted about a respective axle 28. In this manner, an infant to induce such infant to utilize the boot structure of the instant invention, permits the infant to amuse and entertain himself in a seated manner, such as indicated in FIG. 1.

Figure 9:
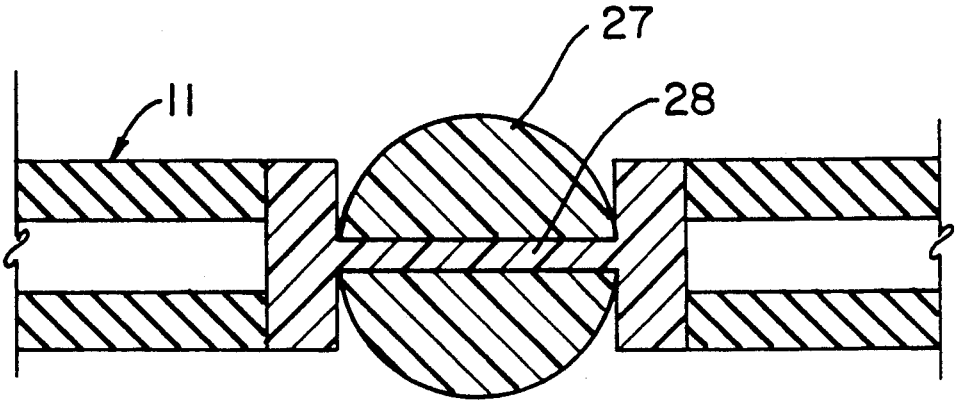
FIG. 9 is an orthographic view, taken along the lines 9—9 of FIG. 8 in the direction indicated by the arrows.

The FIGS. 8 and 9 further indicates the use of the toe-like projections 29, with the toe projections arranged in communication with the pneumatic chamber 17, whereupon an infant in chewing the toe projections 29 effects compressing of air through the pneumatic chamber and subsequently through the whistle member 18. Further, at least one of the toe projections 30 positioned as an outermost toe projection 30 for ease of access thereto includes a fluid reservoir 31. The fluid reservoir 31 includes a reservoir aperture 34 to permit the ingestible fluid 33 contained within the reservoir to be directed through the reservoir aperture 34 to the outermost toe projection 30 projecting beyond the outer boot shell 11, where a matrix of toe projection apertures 36 are directed through the fluid impermeable toe wall of the outermost toe projection to permit ingestion of such fluid 33. The reservoir apertures 34 is typically directed through a partition wall 35 positioned in adjacency to the toe projection apertures 36 to direct the fluid 33 towards the toe projection apertures 36, as indicated. The toe projection is formed of a fluid impermeable material permitting fluid flow only through the toe projection apertures.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sound emitting infant boot structure, comprising, an outer boot shell and an inner boot shell, having an enclosed pneumatic chamber therebetween, with a whistle member directed through the outer boot shell in communication with the pneumatic chamber arranged to emit an audible whistle upon compression of the pneumatic chamber during a walking procedure, and the whistle member includes a rigid support tube, with the outer boot shell and inner boot shell formed of a flexible pneumatically impermeable material, and the support tube includes a first, second, and third diaphragm plate, and the first diaphragm plate having a first whistle aperture, the second diaphragm plate having a second whistle aperture, the third diaphragm plate having a third whistle aperture, and wherein the first whistle aperture, the second whistle aperture, and the third whistle aperture are offset relative to one another within the support tube, and an outer shell recess directed into the outer boot shell, wherein the outer boot shell recess includes a row of spherical members, each spherical member rotatably mounted about an axle within the recess for entertainment of an infant, and a plurality of toe projections projecting beyond the outer boot shell, with at least one of the toe projections having pneumatic communication with the pneumatic chamber, whereupon compression of the at least one toe projection effects compression of air from within the pneumatic chamber for effecting a whistle through the member, and a further one of the toe projections includes a fluid reservoir having an adjustable fluid therewithin, and a partition wall positioned within the further one toe projection, and the partition wall having a reservoir aperture directed therethrough in communication with the at least one toe projection extending beyond the outer boot shell, and wherein the at least one toe projection extending beyond the outer boot shell includes a plurality of toe projection apertures in fluid communication with the fluid reservoir and the fluid reservoir aperture, and wherein the at least one toe projection extending beyond the outer boot shell is formed of a fluid impermeable material permitting fluid flow only through the toe projection apertures.

* * * * *